US008720492B2

(12) United States Patent
Vanderjeugt et al.

(10) Patent No.: US 8,720,492 B2
(45) Date of Patent: May 13, 2014

(54) SELECTION DEVICE FOR THE SHED-FORMING DEVICE OF A WEAVING MACHINE

(75) Inventors: Bram Vanderjeugt, Ypres (BE); Matthew Theobald, Whittonstall (GB); Stefaan Vanheesbeke, Ledegem (BE)

(73) Assignee: Michel Van de Wiele NV, Kortrijk/Marke (BE)

( * ) Notice: Subject to any disclaimer, the term of this patent is extended or adjusted under 35 U.S.C. 154(b) by 0 days.

(21) Appl. No.: 13/521,348

(22) PCT Filed: Jan. 10, 2011

(86) PCT No.: PCT/IB2011/000021

§ 371 (c)(1), (2), (4) Date: Jul. 10, 2012

(87) PCT Pub. No.: WO2011/086446

PCT Pub. Date: Jul. 21, 2011

(65) Prior Publication Data

US 2012/0285578 A1 Nov. 15, 2012

(30) Foreign Application Priority Data

Jan. 15, 2010 (BE) ..... 2010/0022

(51) Int. Cl.
*D03C 9/06* (2006.01)
*D03C 13/00* (2006.01)

(52) U.S. Cl.
USPC ..... 139/55.1; 139/59; 139/65; 139/455

(58) Field of Classification Search
USPC ..... 139/455, 55.1, 66 R, 435.1, 59, 65
See application file for complete search history.

(56) References Cited

U.S. PATENT DOCUMENTS 4,858,654 A * 8/1989 Derudder ..... 139/59
5,020,573 A * 6/1991 Debaes ..... 139/453
5,038,837 A * 8/1991 Palau et al. ..... 139/65
5,373,871 A * 12/1994 Speich ..... 139/455

(Continued)

FOREIGN PATENT DOCUMENTS

EP 119787 B1 11/1988
EP 0214075 B1 12/1988

(Continued)

OTHER PUBLICATIONS

International Search Report dated Jul. 4, 2011.

*Primary Examiner* — Bobby Muromoto, Jr.
(74) *Attorney, Agent, or Firm* — Symbus Law Group LLC; Clifford D. Hyra

(57) ABSTRACT

A selection device for a shed-forming device of a weaving machine has an electromagnetic selector (11) with at least two poles ($P_1$), ($P_2$), . . . ($P_n$) and a selection element (1), (2); (25), (26); (40), (41) which is located in a cooperating position with a zone (50) alongside at least two poles ($P_1$), ($P_2$), . . . ($P_n$) and is retained at a holding distance (A) from this zone (50), in which the selector (11) with each adjacent pole ($P_1$), ($P_2$) can exert a magnetic force on the zone (50), and in which the zone (50) extends over a distance (Z) that is shorter than the coil length (S), while the holding distance (A) is at least equal to half the positionable length (L) of the selection element.

24 Claims, 12 Drawing Sheets

(56) References Cited

U.S. PATENT DOCUMENTS

| | | | | | |
|---|---|---|---|---|---|
| 5,666,999 | A * | 9/1997 | Dewispelaere et al. | 139/455 |
| 5,671,784 | A * | 9/1997 | Dewispelaere | 139/455 |
| 5,694,982 | A * | 12/1997 | Debaes | 139/453 |
| 5,743,308 | A * | 4/1998 | Bassi et al. | 139/455 |
| 6,053,216 | A * | 4/2000 | Debaes et al. | 139/103 |
| 6,073,663 | A * | 6/2000 | Dewispelaere | 139/455 |
| 6,085,803 | A * | 7/2000 | Dewispelaere | 139/455 |
| 6,279,618 | B1 * | 8/2001 | Speich et al. | 139/59 |
| 6,382,263 | B2 * | 5/2002 | Dewispelaere | 139/455 |
| 6,478,055 | B1 * | 11/2002 | Dewispelaere | 139/455 |
| 6,935,381 | B2 * | 8/2005 | Debuf et al. | 139/2 |
| 6,941,977 | B2 * | 9/2005 | Reiter | 139/455 |
| 7,017,618 | B2 * | 3/2006 | Bassi et al. | 139/59 |
| 7,117,898 | B1 * | 10/2006 | Irmer et al. | 139/59 |
| 7,285,745 | B2 * | 10/2007 | Simoen | 219/121.64 |
| 7,490,633 | B2 * | 2/2009 | Bouchet et al. | 139/59 |

FOREIGN PATENT DOCUMENTS

| | | | |
|---|---|---|---|
| EP | 0779384 | A1 | 6/1997 |
| EP | 1006226 | A1 | 6/2000 |
| WO | 0032859 | A1 | 6/2000 |

* cited by examiner

SELECTION DEVICE FOR THE SHED-FORMING DEVICE OF A WEAVING MACHINE

This application claims the benefit of Belgian patent application No. 2010/0022, filed Jan. 15, 2010, which is hereby incorporated by reference in its entirety.

BACKGROUND

When weaving a fabric on a weaving machine, the warp threads are positioned with respect to the level at which a pick thread is introduced in each weaving cycle during the successive weaving cycles. This positioning of warp threads is referred to as the shed formation. The positions of the warp threads in the successive weaving cycles are in this case determined in such a manner that the weaving process results in a fabric having a predetermined weaving pattern. This positioning of warp threads with respect to the pick introduction level on a weaving machine is automatically realized by means of a shed-forming device.

With a known jacquard shed-forming device each warp thread to be positioned passes through a heddle eyelet of a heddle. At the bottom, each heddle is connected to a retracting spring which exerts a downwardly directed force on the heddle and, at the top, is connected, via a harness cord, to the end of a tackle cord of a tackle system, which end is situated at a higher level. The tackle system comprises two hooks which are displaceable in the vertical direction. The position of the hooks determines the height of the end of the tackle cord.

Each hook can be displaced in the vertical direction by a respective knife. These two knives are driven so as to move in a reciprocating manner in opposite phases with respect to one another. Each hook comprises an elastically deformable strip which can be placed in a selection position by means of an electromagnetic selector in which the hook is not caught by its knife and kept at a fixed height (is selected). If a hook is placed in the non-selection position, it is caught by a reciprocating knife.

By selecting or not selecting the respective cooperating hooks, a warp thread can, via the tackle cord and the heddle, be brought to the required position during the successive weaving cycles in order to produce the desired fabric.

There are also shed-forming devices which comprise a holding element with a flexible strip or a rotating pawl which can be positioned with respect to a hook by an electromagnetic selector. This strip or pawl of the holding element can then be brought into a selection position in which the holding element keeps the hook at a fixed height, or can be brought into a non-selection position in which the hook is caught by a knife. In this case, the holding element thus acts as a selection element.

With a number of known shed-forming devices, the selection of the hooks is carried out by means of a selection device which has the features described in the first paragraph of this description.

Jacquard machines comprise large numbers of these shed-forming devices. There is an increasing market demand to provide jacquard machines with ever larger numbers of shed formation elements, while at the same time keeping the so-called footprint (the perpendicular projection on a horizontal plane) of the device limited. The reduction in the footprint of the hook-selecting devices offers a solution. A reduction in the dimensions of the knives in the longitudinal direction is in this case the most advantageous, as this makes it possible to reduce the number of knives or the height of the knives since the span between the suspension points can be reduced. This reduces the inertia of the components of the shed-forming device which are to be driven, as a result of which the shed-forming device can be produced more inexpensively.

With the shed-forming device according to EP 0,119,787, the selection device comprises a solenoid, the longitudinal axis of the coil of which extends in the longitudinal direction of the knives. At the position of the end faces of the core, thin plates are provided which are bent towards one another. The plates act as magnetic poles by means of which a reciprocating hook of a shed-forming device can be placed in the selection position. This selection device has a relatively large footprint. Reducing the coil length is not the solution to this problem, as this limits the space for the windings. The smaller the space for the copper, the higher the energy consumption in order to achieve a desired attractive force. Compensating by increasing the coil diameter is not a solution as this increases the footprint in the other horizontal direction. In addition, the resistance increases significantly with a larger coil diameter, thus requiring more power. The poles in this case also extend along a relatively large length which results in a relatively large magnetic leakage loss. As a result of miniaturisation, these plates come to lie closer together so that the magnetic leakage flux increases significantly. This is one of the reasons why the efficiency is low, in the sense that a relatively large amount of power is required in order to achieve a certain attractive force.

EP 0,214,075 describes a selection device with a vertically arranged coil which is designed to magnetically influence a thin strip of elastic material so that it is brought into a selection position by elastic deformation. This device also requires a relatively large amount of electrical power in order to achieve an efficient attractive force. In addition, this selection device has a limited speed of response.

Materials which have excellent elastic deformability and resistance to fatigue, such as spring steel, offer poor magnetic conductivity. In order to reduce the amount of electrical power required, a material having a better magnetic conductivity could be chosen, but these materials then have the drawback that they have a smaller resistance to fatigue, causing them to break more quickly. This results in a selection device which does not meet today's requirements in terms of reliability and service life.

With many selection devices, it is also the case that the positionable part cannot be made very thick as this would cause the inertia and the restoring force required to be too high. The limited thickness and the choice of material together restrict the number of magnetic field lines which can run through the magnetically influenceable zone of the selection element.

Due to the demand for increased production speeds, the selection devices have to have higher speeds of response and greater reliability has to be achieved.

SUMMARY

The present invention relates to a selection device for the shed-forming device of a weaving machine comprising

- an electromagnetic selector with a coil wound around a fixed core and at least two poles connected to this core designed to form at least one magnetic north pole and at least one magnetic south pole,
  and
- a selection element with a positionable part which, when the selection element is situated in a cooperating position near the selector, comprises a magnetically influenceable zone situated next to at least two of the poles, while the selection element is retained at a holding distance from this zone, in which the selector can be controlled in order to exert a magnetic force with each pole situated next to the selection element on this zone so as to place or keep the positionable part in a selection position or a non-selection position in accordance with a predetermined weaving pattern.

It is an object of this invention to correct the abovementioned drawbacks by providing a reliable selection device with an improved speed of response than the known selection devices, in which the electrical power required can be reduced significantly and which, moreover, is also configured to have a relatively small footprint.

These objects are achieved by providing a selection device in which said zone extends in the longitudinal direction of the positionable part of the selection element over a distance (Z) that is shorter than the coil length (S), while said holding distance (A) is equal to at least half the length (L) of the positionable part.

Said zone extends around the poles and it is mainly in this zone that the magnetic force is exerted. The zone is determined by the perpendicular projection of the end faces of the poles onto the magnetically conductive material of the selection element and extends between those edges of the projection of the end faces which are furthest apart. This is the case if there are two poles, but even if there are more than two poles, those edges of the projections of this plurality of poles which are furthest apart determine said zone.

It goes without saying that the poles which are situated next to the selection element comprise at least one north pole and at least one south pole.

If a selection element is used with a recess which is situated in the cooperating position next to one or more poles and if, in addition, this recess coincides with a part of the perpendicular projection of pole end faces which determines the boundaries of said zone (i.e. a part of the projection which extends up to or beyond one of said edges of the projection which are furthest apart), then the edge of the zone is displaced by said recess (as there is no magnetic influencing of the selection element at the location of the recess), so that the length (Z) of the influenceable zone will then be smaller than the distance between the upper edge of the upper end face and the lower edge of the lower end face of the pole legs which belong together.

Both edges of the zone can be displaced in this manner by means of a respective recess in the selection element.

The holding distance (A) is the distance between the zone in which the magnetic forces are exerted and the holding point. The holding point is the location where the selection element is held so that it cannot be displaced to the poles, but can only be deformed (with an elastically deformable selection element) or is the point of rotation (with a rotating arm or pawl).

The magnetic force is developed at each transition between the magnetic poles and the material of the selection element. By moving the two or more magnetic poles away from the holding point, a larger moment of force is achieved than with the selection devices according to the prior art. As a result thereof, the speed of response varies significantly.

By moving the magnetic poles away from the holding point, it is possible to achieve the same deformation or displacement as with the existing selection devices (for example counter to a spring force) by means of a relatively small magnetic force.

In addition, the two magnetic poles are brought closer together, as a result of which the magnetically influenceable zone becomes smaller. The path of the flux passage thus becomes much shorter, so that less electrical energy is required to achieve a desired flux. This is of particular interest when working with selection elements made of poorly magnetically conductive material (such as spring steel, because of its good elastic properties) or when the magnetically influenceable zone is designed as a thin strip and thus has a limited cross section. Due to the path of the flux being shorter, the power required is reduced.

In addition, such a selection element only allows a limited magnetic flux in the longitudinal direction across its cross section. This flux can be used more efficiently in order to produce the attractive force by reducing the magnetic poles, which therefore also results in shorter length of the magnetically influenceable zone. The magnetic induction through the air gap between the poles and the selection element is thus increased and the associated attractive force therefore also rises significantly, since this is inversely proportional to the surface of the end faces of the magnetic poles.

Moreover, it is possible to remove material from the zones where no flux passage takes place or to use a different, preferably lighter, material. Thus, it is possible, for example, to use plastic to produce certain zones. As a result thereof, the speed of response and the restoring force can be improved and adjusted as desired.

In an embodiment with a rotating arm or pawl, it is not necessary to make the entire pawl from readily magnetically conductive material, but to restrict this to the zone where flux passage takes place. This not only offers advantages in terms of the cost price, but also allows the inertia to be reduced, as a result of which the speed of response and the maximum performance speed will increase.

The coil is preferably arranged in such a manner that its longitudinal axis extends along the longitudinal direction of the positionable part of the selection element.

Such a selection device has a minimal footprint which does not depend on the coil length.

In a preferred embodiment, the positionable part of the selection element is forced towards the selection position or the non-selection position by a spring force and this positionable part can be displaced to the other of these positions by said magnetic influence opposed to this spring force.

The positionable part of the selection element may in this case be either elastically deformable and be forced into the selection position or the non-selection position by its spring force, or may be designed as a rotating arm which is forced into the selection position or the non-selection position by a spring element.

In a most preferred embodiment, the elastically deformable positionable part of the selection element is made of spring steel, for example a thin strip of spring steel. This material offers particularly good elastic deformability and resistance to fatigue.

In a first important embodiment, the selection element is a shed-forming element with a positionable part which can be placed in a selection position in which the shed-forming element is held at a fixed height and can be placed in a non-selection position in which the shed-forming element can be displaced in order to change the position of one or more warp threads in accordance with the desired weaving pattern.

In this case, the direction of displacement of the shed-forming element preferably corresponds to the longitudinal direction of the coil.

In a second important embodiment, the selection element is a holding element with a positionable part which can be placed in a selection position or a non-selection position in order to optionally keep a shed-forming element in a certain position with respect to the holding element so as to determine the position of one or more warp threads in accordance with the desired weaving pattern.

This holding element can either be arranged at a fixed height or be connected to a moveable component of the shed-forming device. Thus, the holding element can either be connected to a selector arranged at a fixed height or be connected to a reciprocating knife of the shed-forming device.

In a particularly advantageous embodiment, openings or recesses or local adjustments in the transverse dimensions are provided in the positionable part. As a result thereof, it is possible to reduce both the inertia and the restoring force of the selection element to the desired value. If the restoring force is reduced, this means that the attractive force required to achieve a certain deformation or displacement can be reduced.

When the selection element is in a cooperating position near the selector, said poles are preferably located along the same side of the positionable part. As a result, the forces exerted by these poles act in the same direction on the selection element.

The distance, measured in the longitudinal direction of the positionable part, between the level at which the selection element is retained and the end of the coil located closest to that level is preferably less than said holding distance (A). In other words, the coil end is located closer to the level at which the selection element is retained than the magnetically influenceable zone.

The level at which the selection element is retained, also referred to below as the holding level corresponds to the level of the holding point defined above.

The poles are therefore not only closer together than the coil ends (Z<S), but also the pole which is connected to the core on the side closest to the holding level is also moved away from the holding level. As a result, the zone where the magnetic force is applied is moved away from the holding point resulting in a greater moment of force.

The selection element preferably comprises a first holding means which is intended to interact with a second holding means of a shed-forming element in order to hold this shed-forming element in a specific position or with a second holding means which is provided at a fixed height, so that the selection element itself is held at a fixed height, said zone of the selection element in any event extending between said first holding means and the level at which the selection element is retained.

A preferred selection device can be embodied in such a way that in moving along the device in the longitudinal direction of the positionable part, the holding level, a coil end, the zone and the abovementioned first holding means are passed in succession.

Said first holding means may be an opening or recess in the selection element, while the second holding means is a hook-shaped projection which is provided, for example, on the selector, so that the selection element is attached to the selector when the projection is seated in the opening or recess. In an alternative embodiment, a hook-shaped projection, which can engage in an opening, can be provided on the selection element. Both holding means may also be designed as interacting hook-shaped elements.

Said magnetic poles are preferably also provided in such a way that their perpendicular projections onto a plane that extends in said longitudinal direction of the positionable part are located above or next to one another.

In the direction of the longitudinal axis of the coil, the arrangement of magnetic poles preferably extends over a distance that is less than the coil length (S).

In a particular embodiment of this selection device, the ratio between on the one hand the length (Z) of said magnetically influenceable zone of the positionable part and on the other hand the coil length (S) is at most equal to 0.8. More specifically, this ratio is optimally less than 0.7, and an upper limit of 0.6 is even more preferable.

In a particular embodiment, this ratio is at most equal to 0.5. A highly suitable ratio (Z/S) is approximately 0.46. This ratio (Z/S) is preferably no greater than 0.4. In a more preferred embodiment, this ratio (Z/S) may be between 0.4 and 0.3. The options include a lower limit of 0.2 or even 0.1.

The ratio (A/L) between said holding distance (A) and the length (L) of the positionable part is in a particularly advantageous embodiment equal to at least 0.55. In a most preferred embodiment, a ratio (A/L) of approximately 0.60 is adopted. Therefore, the positionable part of a hook designed as flexible strip may have a length (L) of approximately 45 mm, while the distance (A) between the magnetically influenceable zone and the level at which this hook is retained (the holding distance) is approximately 26 mm. The influenceable zone then has a length (Z) of, for example, approximately 8.5 mm. The coil length (S) is then for example approximately 18.5 mm. In this exemplary embodiment, the ratio Z/S=0.46. The ratio A/L is in this case 0.58.

The ratio between on the one hand the holding distance (A) and on the other hand the sum of this holding distance (A) and the length (Z) of the zone can also be considered a relevant ratio for the purposes of the present invention. In the above example, this ratio A/A+Z is approximately 0.75.

The length (S) of the coil is preferably between 12 mm and 25 mm, in which case any value between these limits may be considered. The length (Z) of the magnetically influenceable zone is preferably between 6 mm and 10 mm, in which case every value within these limits may be considered. The holding distance (A) is preferably between 20 mm and 32 mm, in which case every value between these limits may be considered. The length (L) of the positionable part of the selection element is preferably between 40 mm and 50 mm, in which case every value within these limits may be considered.

Obviously, other values outside the above limits are also possible for Z, S, A and L.

The present invention also relates to an assembly of selection devices comprising at least two selection devices according to the invention, wherein at least two selectors of the assembly form part of a separately removable module. It is preferable to provide 8 to 12 selectors per module.

In such an assembly of selection devices, the selectors are preferably incorporated into said module in at least two rows positioned at different levels. In a highly preferred embodiment, the selectors of these different rows are offset with respect to one another in the longitudinal direction of these rows.

The assembly according to the present invention may also be provided with a number of selection elements which can be placed in a selection position or a non-selection position in order for a shed-forming element to be held or not to be held in a specific position in order to position one or more warp threads, with a plurality of these selection elements forming part of the same unit.

This enables various selection elements to be simultaneously put into or taken out of the device. Said unit can preferably be removed from the shed-forming device together with the removable module.

Said assembly preferably comprises a removable module which, in addition to a number of selectors, also comprises the shed-forming elements, tackle elements and tackle cords.

The present invention also relates to a shed-forming device for a weaving machine which is provided with a number of selection devices according to the present invention, or at least one assembly of selection devices according to the present invention.

The following description will provide a detailed description of a number of preferred embodiments of a shed-forming device with selection device according to the invention. A number of particular embodiments of the solenoid will also be looked at in greater detail. This detailed description is intended only to indicate how the invention can be implemented and to illustrate and explain as appropriate the action and particular features of the invention. This description therefore cannot be considered to restrict the scope of patent protection. The application area of the invention also may not be restricted on the basis of this description.

BRIEF DESCRIPTION OF THE DRAWINGS

This description refers to the accompanying figures, wherein:

FIGS. 1 to 3 show a diagrammatic illustration of various shed-forming devices with two elastically deformable hooks which in a non-selection position can be caught by knives moving up and down in opposing phase, wherein:

Figure 1:
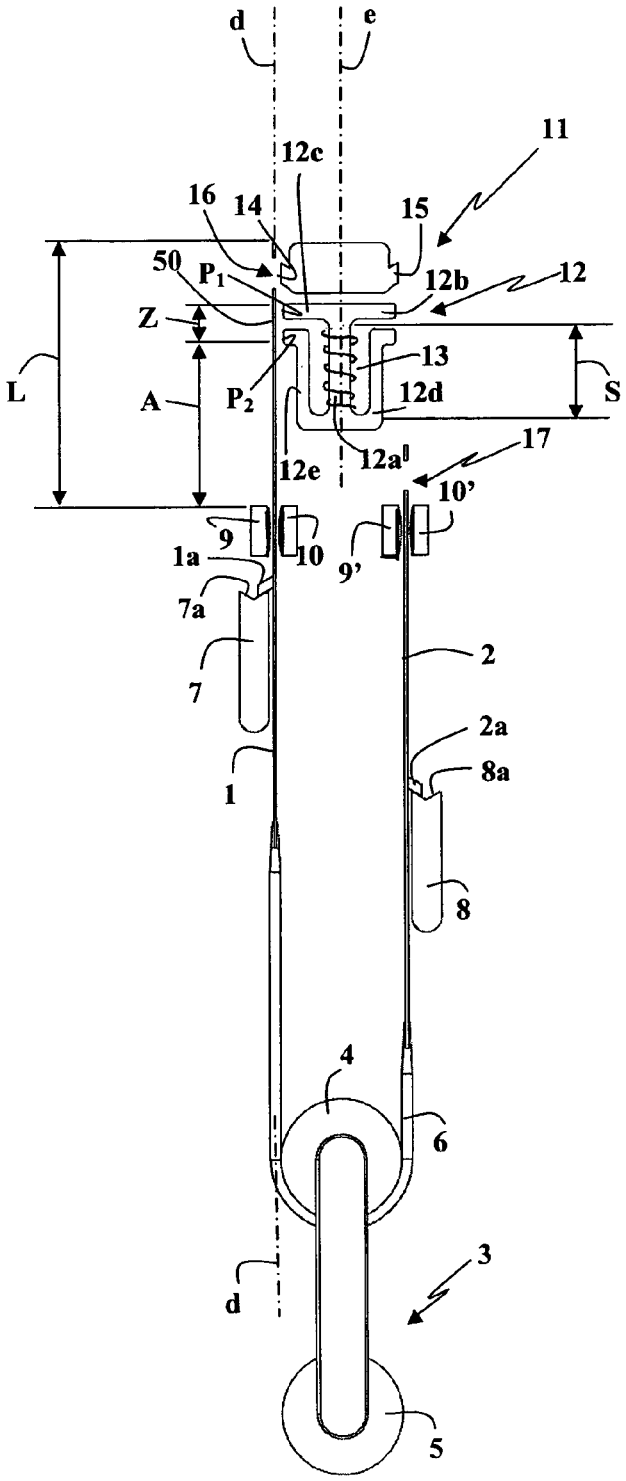
Figure 2:
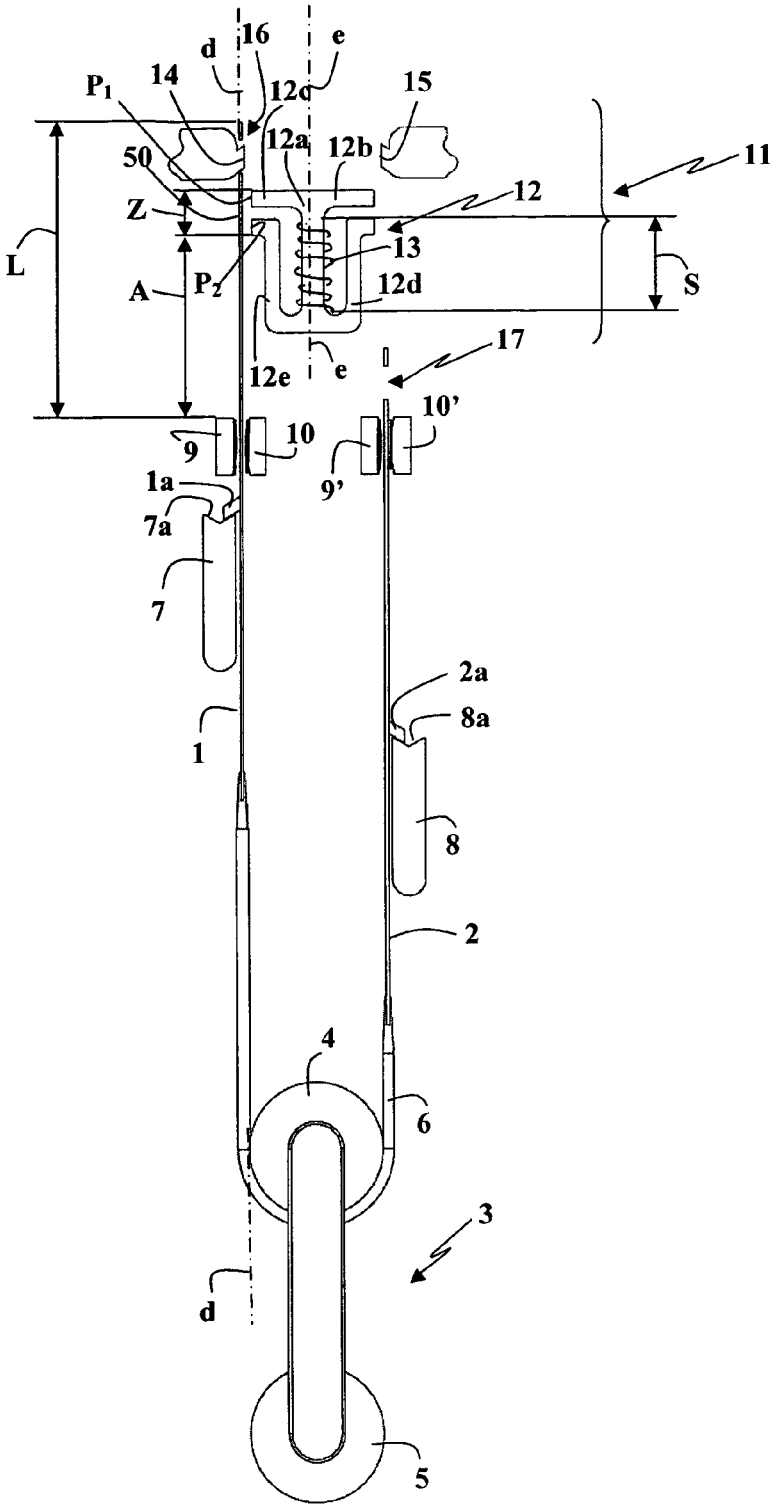
Figure 3:
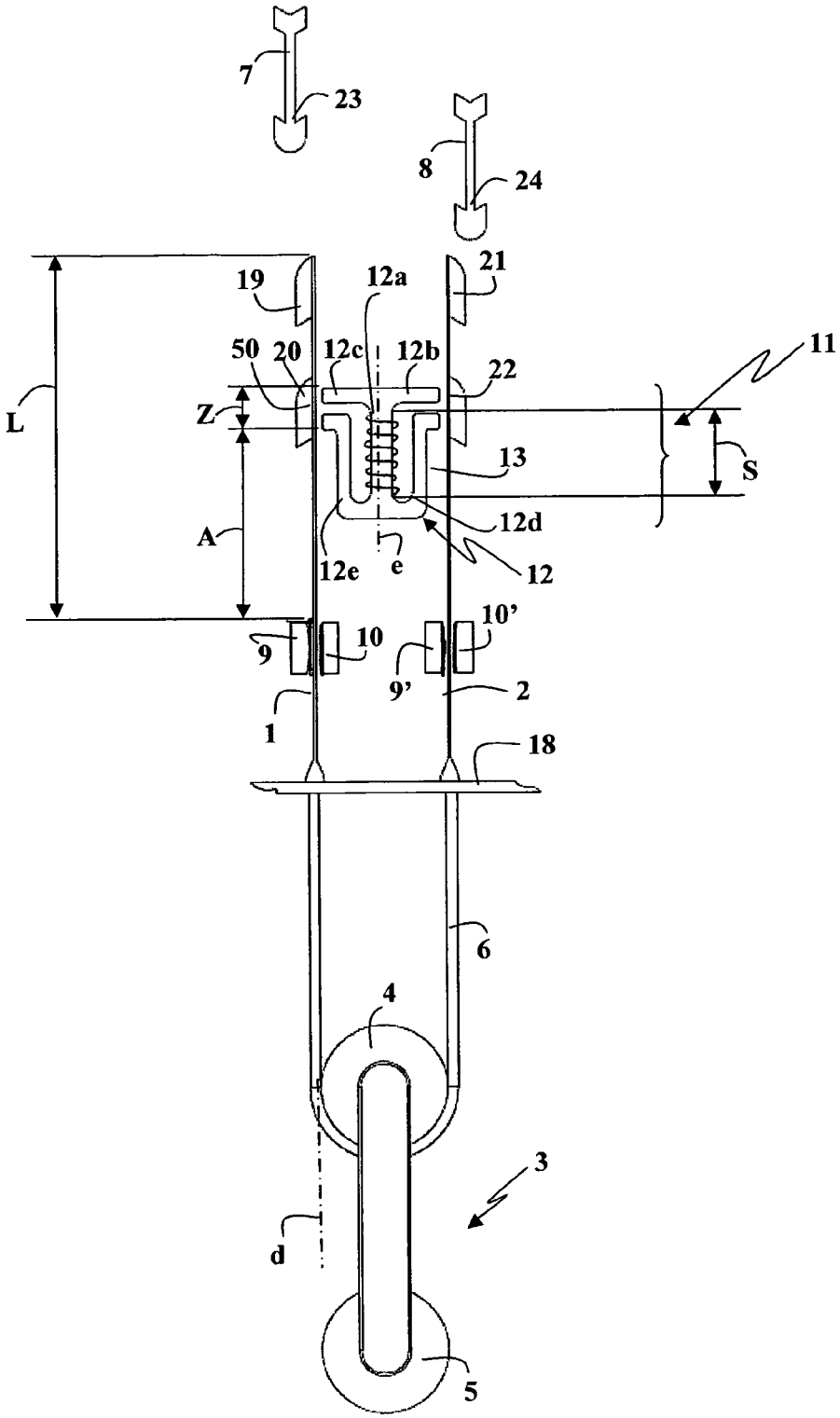

- the hooks in FIG. 1 can be deformed by the selector to adopt a selection position in which they hook onto a fixed holding element,
- the hooks on FIG. 2 are intended to hook onto a holding element in an undeformed state and can be deformed by the selector into the non-selection position, and
- the hooks in FIG. 3 can be formed by the selector into a selection position in which they do not hook onto a knife but rather are supported at a fixed height by a base plank;

FIGS. 4 to 7 show a diagrammatic illustration of various shed-forming devices with two elastically deformable holders which can be positioned by an electromagnetic selector in a selection position or a non-selection position in order for a hook to be held or not to be held at a fixed height, wherein

Figure 4:
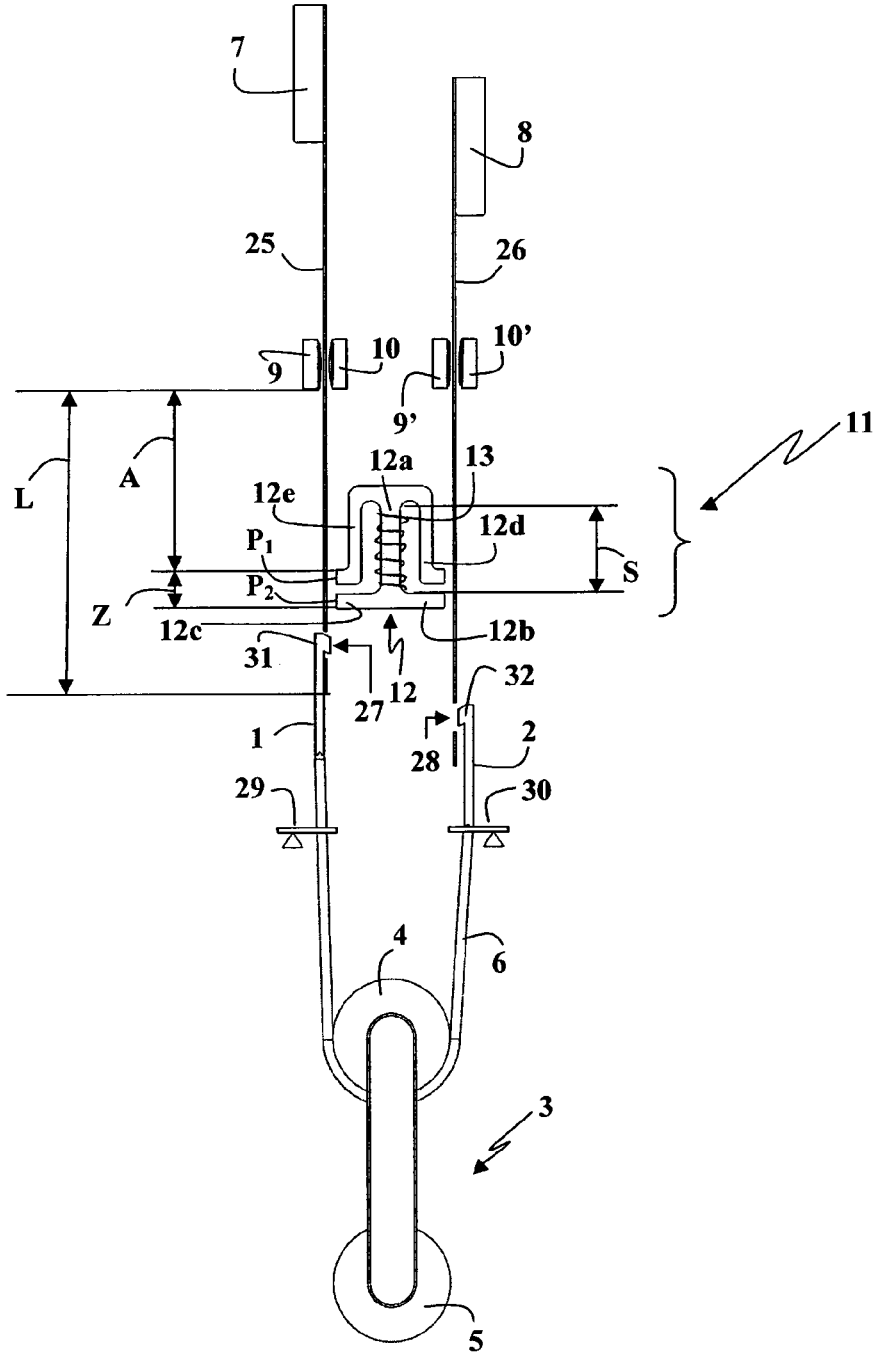
Figure 5:
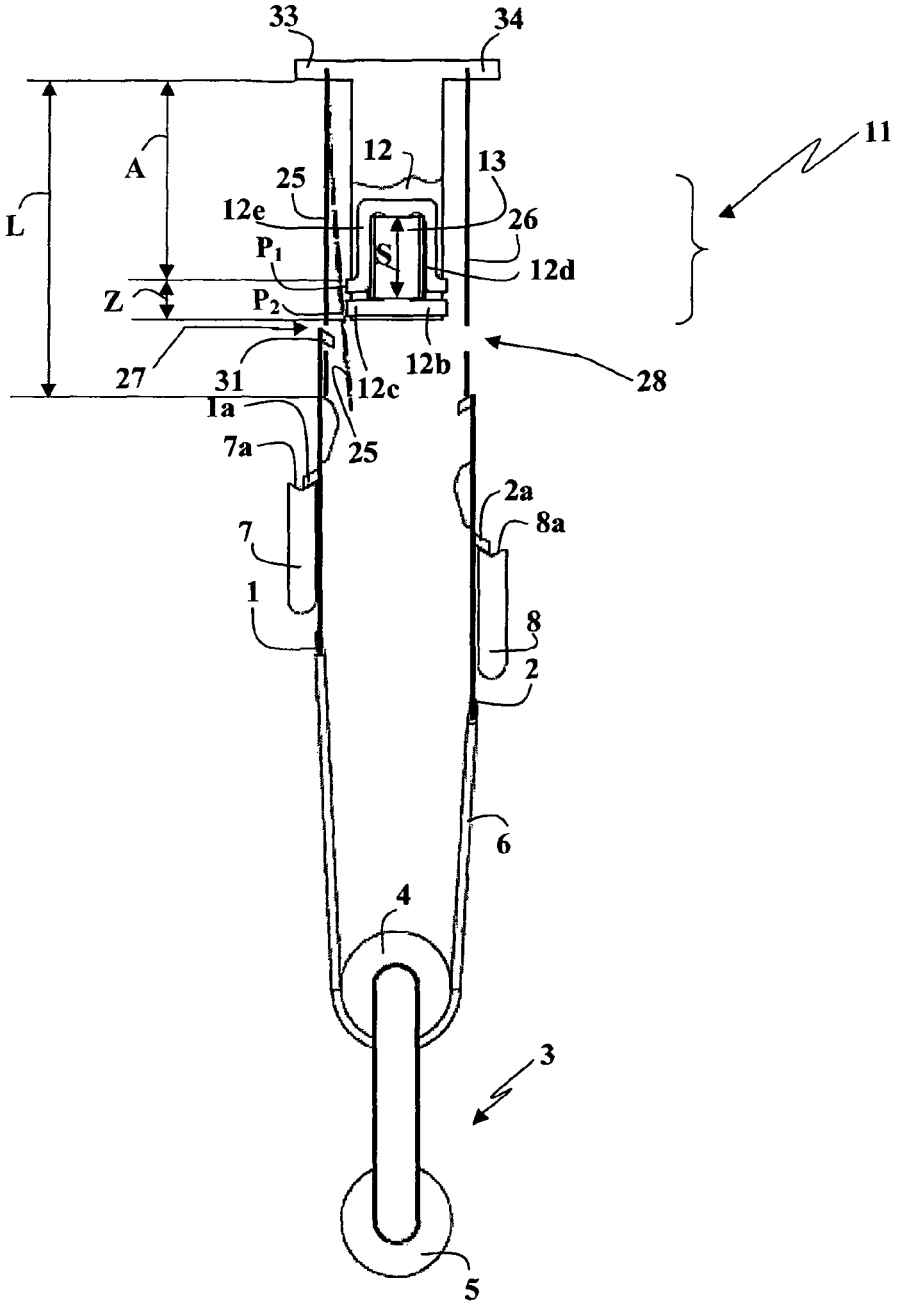
Figure 6:
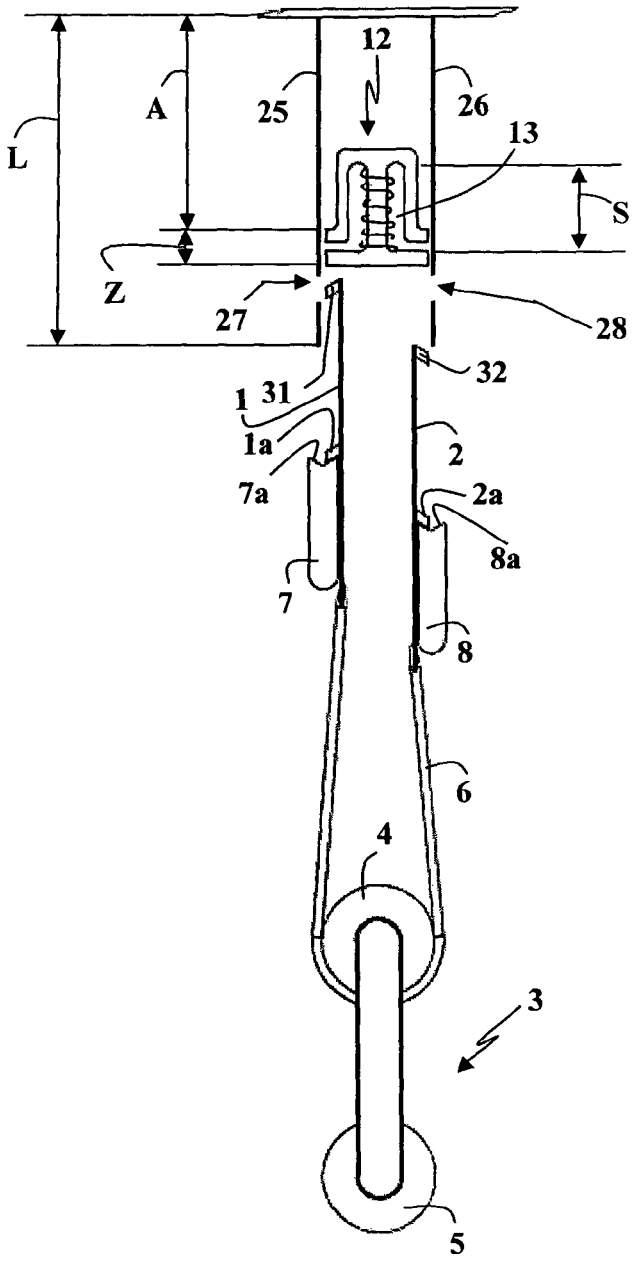
Figure 7:
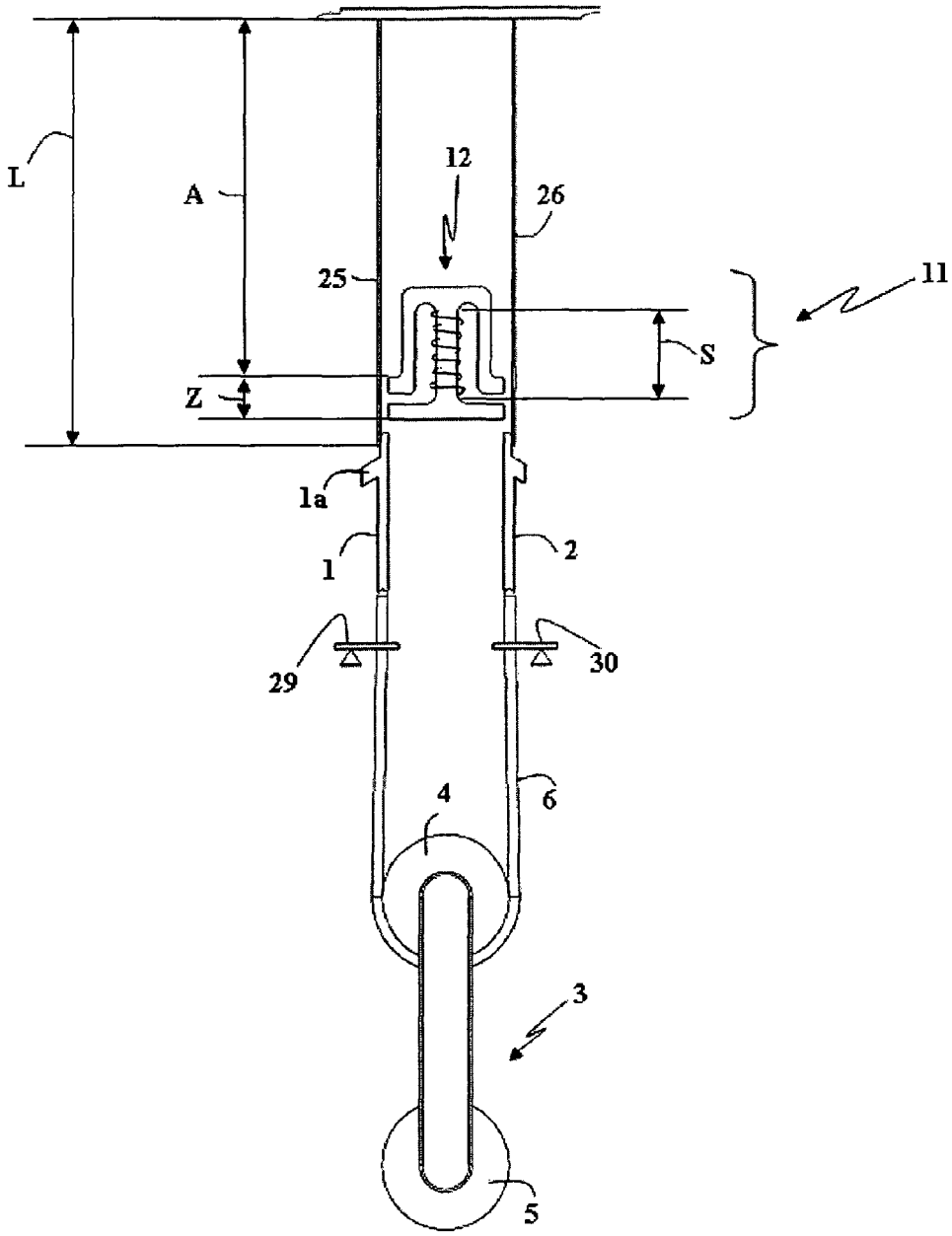

- the holders in FIG. 4 are connected to a respective knife and are intended to hook onto a hook in the undeformed state, so as to be caught by the knife;
- the holders in FIG. 5 are connected to the selector and intended to hook in the undeformed state onto a hook caught by a knife, so that this hook is held at a fixed height.
- the holders in FIG. 6 are connected to the selector and intended to hook in the deformed state onto a hook caught by a knife, so that this hook is held at fixed height, and
- the holders in FIG. 7 are intended to change the position of the hooks supported at a fixed height when they are deformed by the selector, so that the hooks are not caught by a knife, whereas the hooks are caught by a knife when the selection elements are not deformed.

Figure 8:
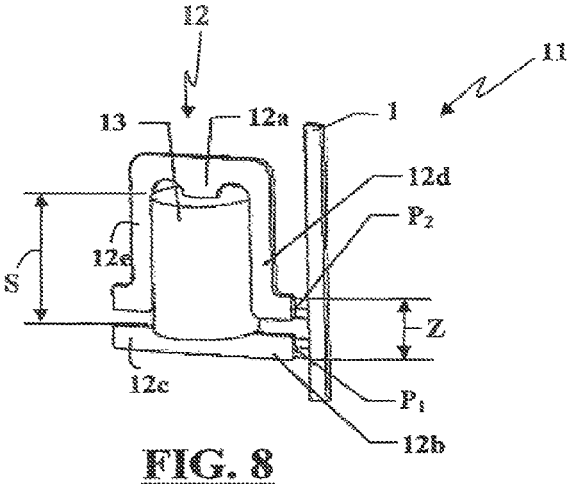
Figure 11:
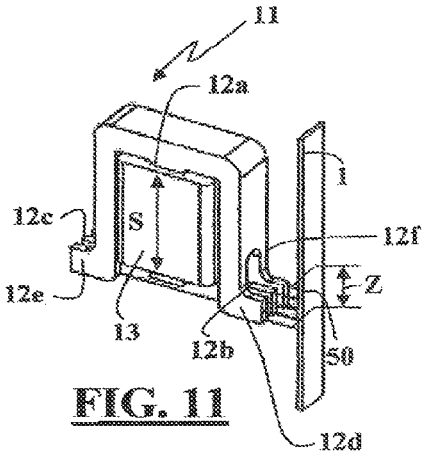
Figure 12:
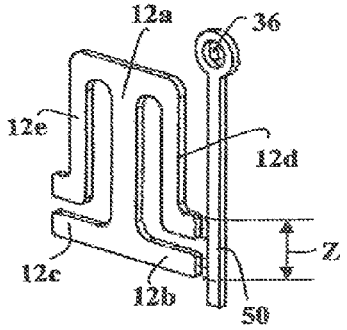
Figure 13:
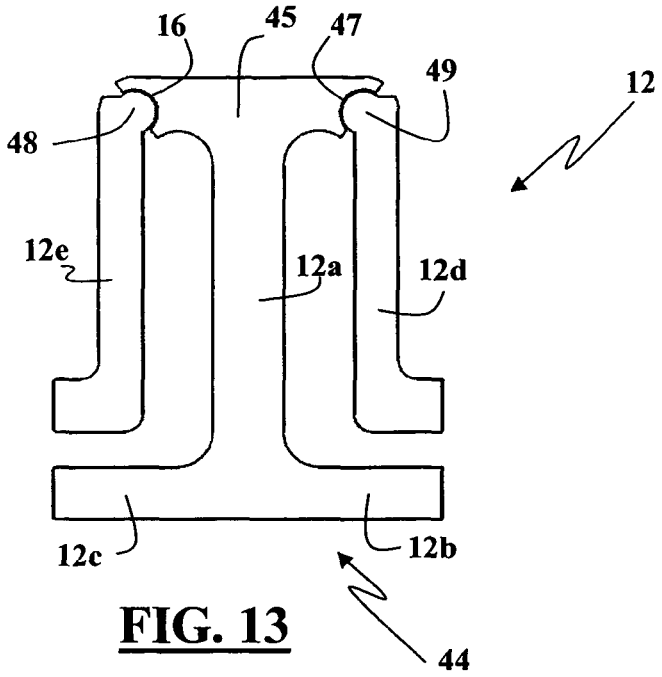
Figure 14:
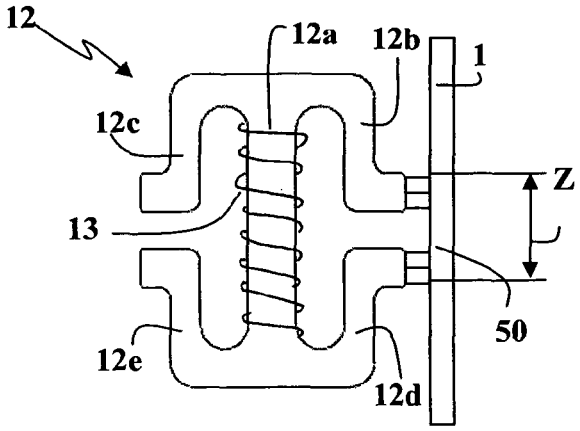
Figure 15:
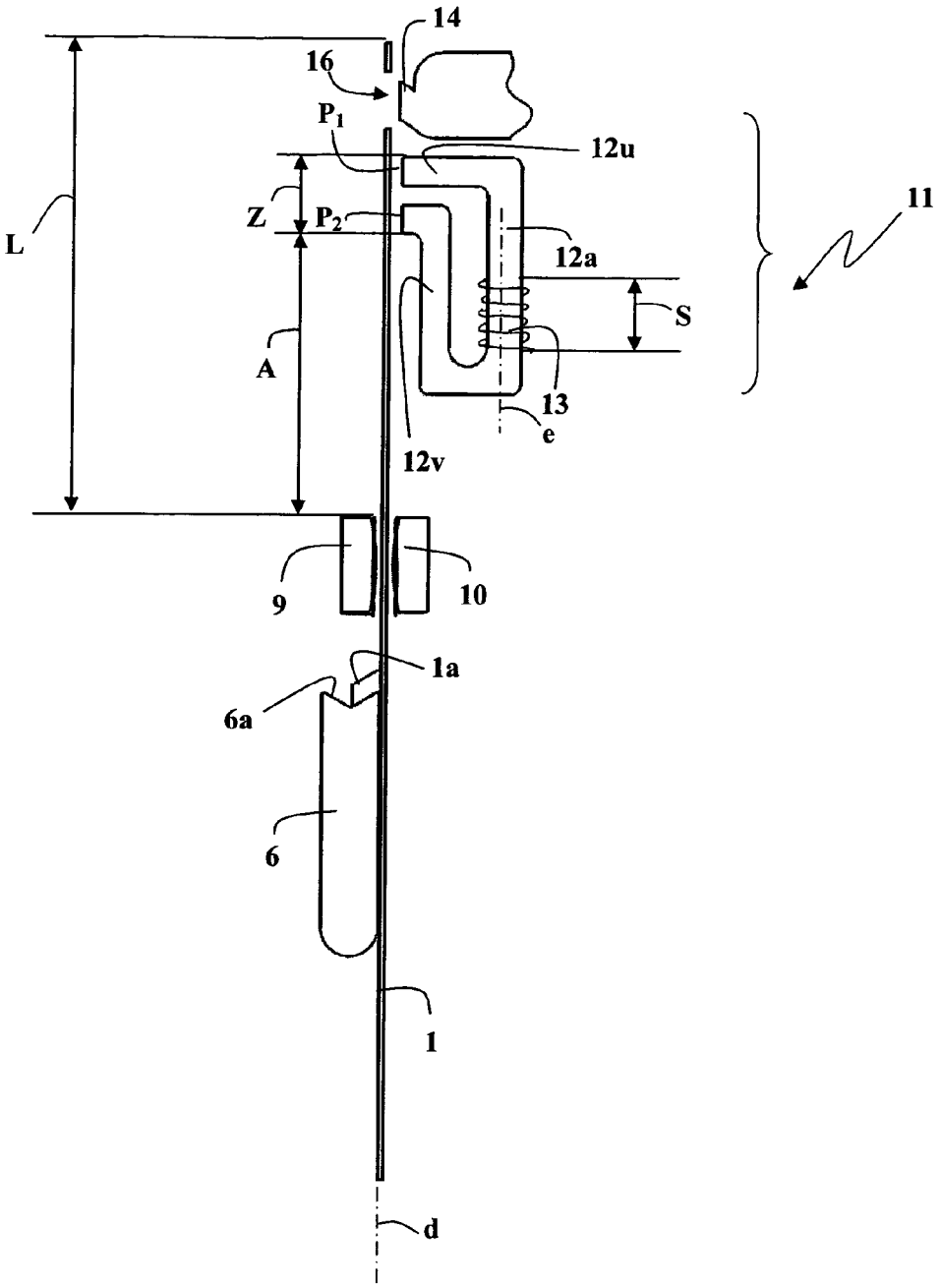
Figure 16:
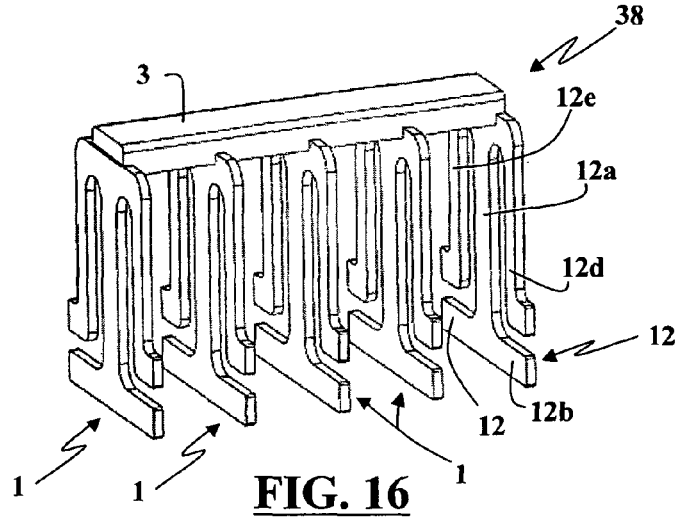
Figure 17:
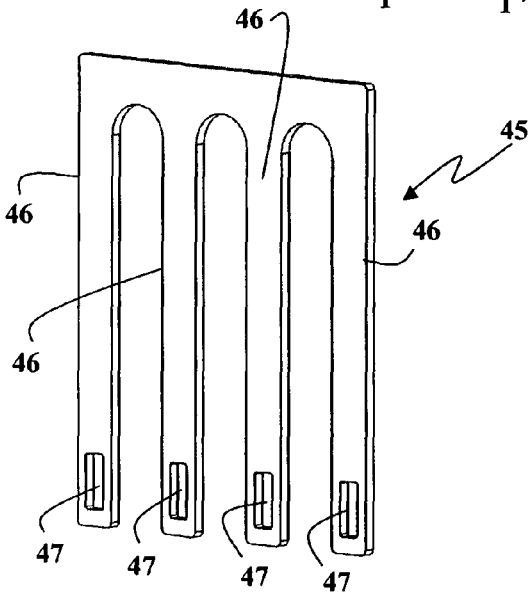
Figure 18:
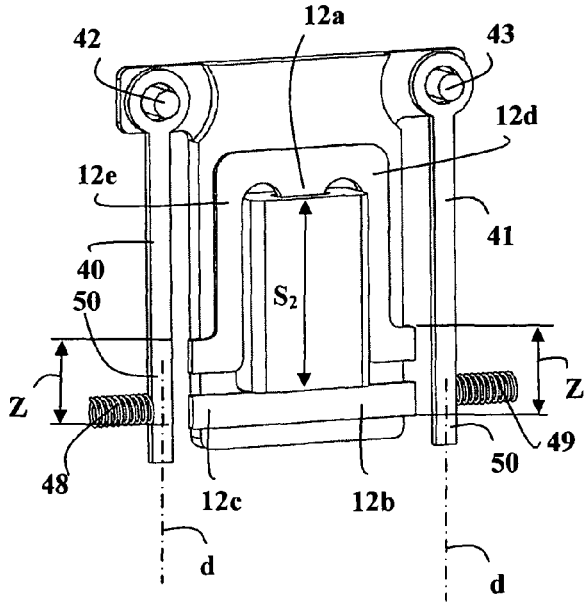
Figure 19:
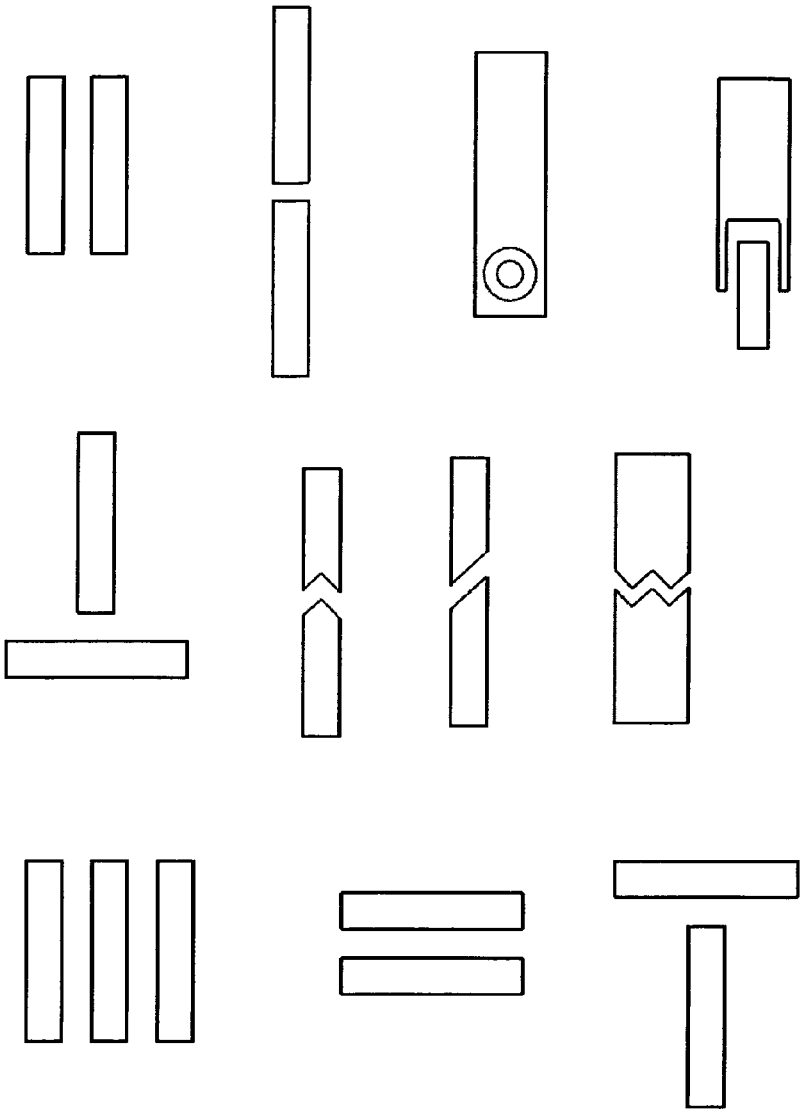

FIGS. 8 to 11 show a perspective view of a number of different embodiments of a selector with associated selection element in accordance with the present invention, FIG. 12 shows a perspective view of the selector body of the selector illustrated in FIG. 8, together with an associated selection element designed as a rotatable pawl;

FIG. 13 shows a front view of a selector body composed of a plurality of parts;

FIG. 14 shows a side view of another embodiment of a selector body;

FIG. 15 shows a diagrammatic illustration of a shed-forming device with one elastically deformable selection element and one two-pole electromagnetic selector, the selector body comprising two poles shifted upwards;

FIG. 16 shows a perspective illustration of the selector body of a module with five selector coils designed as a single unit;

FIG. 17 shows a perspective view of a unit with a number of combined selection elements;

FIG. 18 shows a perspective view of a selection device with two rotatable pawls;

FIG. 19 shows a number of different forms of the pole-forming end faces of the limbs of a selector body.

DETAILED DESCRIPTION OF THE DRAWINGS

The shed-forming devices illustrated in FIGS. 1 to 7 comprise two interacting hooks (1), (2) and a tackle element (3) having an upper tackle pulley (4) and a lower tackle pulley (5). The hooks (1), (2) are connected to one another by means of a tackle cord (6) which hangs downwards and is looped around the upper tackle pulley (4) so that the tackle element (3) is suspended by way of the upper tackle pulley (4) in the downwardly hanging loop of this tackle cord (6). A lower tackle cord, which is not shown in the figures, runs over the lower tackle pulley (5) and its end that hangs downwards is connected to a heddle (likewise not shown) with a heddle eyelet. By changing the height of these hooks (1), (2), it is possible to position the warp threads running through the heddle eyelet, by way of the lower tackle cord and the heddle.

The two interacting hooks of a shed-forming device may also be provided next to one another instead of opposite one another, and in certain embodiments can be actuated by different selectors.

All the shed-forming devices illustrated in FIGS. 1 to 7 interact with a pair of knives (7), (8) which are driven in up and down movement in opposite phase to one another. Each hook (1), (2) can be caught in the vertical direction by a respective knife (7), (8).

In the embodiment shown in FIG. 1, a laterally projecting lip (1*a*), (2*a*) of the hooks (1), (2) can be supported on an upper catching edge (7*a*), (8*a*) of a respective knife (7), (8) and can in this manner be caught by the knife (7), (8). During these vertical movements the hooks (1), (2) move up and down in a guide channel formed by guide means (9), (10); (9'), (10').

At the top dead centre of the up and down movement of a knife (7), (8), the hook (1), (2) supported by this knife is moved past an electromagnetic selector (11) and this hook (1), (2) is in a cooperating position close to the selector (11). This applies specifically to the left-hand hook (1) in FIG. 1.

As shown in FIGS. 8 and 12, the selector (11) comprises a body (12) made from a material with a good magnetic permeance. This body (12) comprises a central limb (12*a*) around which is wound a coil (13) made from electrically conducting material, referred to below as the coil limb (12*a*). The coil limb (12*a*) therefore functions as a core for the coil (13), so as to generate a sufficiently powerful and directional magnetic field when an electric current flows through the coil turns, with the result that a magnetic north and south pole ($P_1$), ($P_2$) are formed at the ends of the core (12*a*).

At both ends of the coil limb (12*a*) there are in each case two limbs (12*b*), (12*c*); (12*d*), (12*e*) which extend in opposite directions on either side of the coil limb (12*a*). These limbs, referred to below as pole limbs (12*b*), (12*c*), (12*d*), (12*c*), result in the formation of a north pole on either side of the coil limb (12*a*) and in the formation of a south pole on either side of the coil limb (12*a*), so that there is a north pole and south pole on each side and so that the same selector (11) can be used to magnetically influence two hooks (hooks (1), (2) in FIGS. 1 to 3) or holding elements (holding elements (25), (26) in FIGS. 4 to 6). On account of the particular shape of the pole limbs, the end parts thereof are relatively close together. When a hook (1), (2) or holding element (25), (26) has been placed in the cooperating position alongside the selector (11), the end parts provided on that side, and in particular the end faces thereof, act as magnetic poles ($P_1$), ($P_2$).

The end faces of the pole limbs functioning as poles ($P_1$), ($P_2$) are in any event closer together than the two ends of the coil limb (12*a*). In the figures, these end faces are positioned in such a way that in the longitudinal direction of the coil they extend over a length that is less than the coil length (S).

In FIGS. 8 to 12 and 14, the flux lines between the end faces of the pole limbs and the opposite selection element are shown symbolically by way of a number of parallel lines. This shows the path followed by the flux. It is this flux which results in a magnetic force acting on the opposite magnetically influenceable zone (50) of the selection element (1), (2); (25), (26), (40), (41).

The pole limbs are formed as follows (see FIGS. 1-7 and FIGS. 8, 12 and 13):

- the first pole limb (12*b*) and the second pole limb (12*c*) are connected to one end of the coil limb (12*a*) and extend over the same transverse distance in opposite directions on either side of the coil limb (12*a*), so that the coil limb (12*a*) and the first (12*b*) and the second (12*c*) pole limb together form a T (FIG. 1-3) or an inverted T (FIGS. 4 to 7, 12 and 13);
- the third (12*d*) and fourth (12*e*) pole limb are connected to the other end of the coil limb (12*a*) and lie in the same plane. This plane is substantially parallel to the plane of the first (12*b*) and second (12*c*) pole limb.
- In an alternative embodiment, the plane of the third (12*d*) and fourth (12*e*) pole limb is not parallel to the plane of the first (12*b*) and second (12*c*) pole limb.
- The third (12*d*) and fourth (12*e*) pole limb run symmetrically with respect to a plane that is perpendicular to the plane of the pole limbs along the longitudinal axis of the coil limb (12*a*). These pole limbs (12*d*), (12*e*), from the end of the coil limb (12*a*), first of all run parallel to the first and second pole limbs, then form a 90° bend, after which they run parallel to the coil limb (12*a*) towards the first (12*b*) and second (12*c*) pole limbs, and finally form another 90° bend, after which their end parts run parallel to the first (12*a*) and second (12*b*) pole limbs. The end parts of the third and fourth pole limbs extend in opposite directions from this bend and end with a respective end face that is located above or beneath the end face of the first pole limb and above beneath the end face of the second pole limb, respectively.

After assembly in a shed-forming device, the end faces of the first (12*b*) and third (12*d*) pole limb lie in virtually the same vertical plane on one side of the selector, where they function (FIGS. 1-7) as north and south poles ($P_1$), ($P_2$) in order to magnetically influence a first hook (1) or holding element (25). The end faces of the second (12*c*) and fourth (12*e*) pole limbs lie in virtually the same vertical plane on the other side of the selector, where they likewise function as north and south poles ($P_1$), ($P_2$) in order to magnetically influence a second hook (2) or holding element (26).

The body (12) with the coil limb (12*a*) and the four pole limbs (12*b*), (12*c*), (12*d*), (12*e*) may be designed as one continuous unit or may be composed of various parts.

For example, the body (12) may be formed (see FIG. 13) from a base part (44), which is substantially in the shape of an inverted T and comprises the coil limb (12*a*) and the first (12*b*) and second (12*c*) limbs, in which case the coil limb (12*a*) at the top ends in a widened section (45) with a socket-shaped recess (46), (47) on either side. The third limb (12*d*) and the fourth limb (12*e*) are designed as separate components and at one end have a convex flank part (48), (49) that fits into a respective socket-shaped recess (46), (47) of the base part (44).

In an alternative embodiment, said widened section (45) may be provided on either side with two convex flank parts which fit into respective socket-shaped recesses on the third (12*d*) and fourth (12*e*) limbs.

The body (12) is assembled to form a unit by placing the convex flank part (48), (49) of the third limb (12*d*) and the fourth limb (12*e*) in a respective socket-shaped recess (46), (47) of the base part (44) and connecting them to the base part (44) by a welded joint or by any other mechanical joining technique.

Before the limbs (12*d*), (12*e*) are connected to the base part (44), these limbs can also be positioned in the socket-shaped recesses (46), (47) by rotation, so that their end faces are optimally positioned above the end faces of the first limb (12*b*) and the second limb (12*c*) before then being joined.

The hooks (1), (2) in FIGS. 1 to 3 are made from spring steel and have a good elastic deformability. When a hook has moved into the cooperating position alongside the selector (11), a certain length (L) of the hook (1), (2) is located above the guide channel between guide means (9), (10); (9'), (10'). The selector (11) can be actuated so as to attract the hook (1), (2). The magnetic attraction takes place substantially in a zone located along the poles ($P_1$), ($P_2$).

In the situation shown in FIGS. 1 to 7, the magnetically influenceable zone has a length (Z) which, measured in the longitudinal direction (d) of the hook or the holding element, corresponds to the distance—measured in this same direction—between the top edge of the top end face and the bottom edge of the bottom end face of the mutually associated pole limbs (12*b*), (12*c*) or (12*d*), (12*e*). This statement applies even if there were to be more than two pole limbs with end faces located above one another.

On account of the particular shape of the pole limbs, the length (Z) of the influenceable zone is much shorter than the coil length (S). A ratio Z/S of at most 1/2 and preferably no higher than 0.4 is selected. A ratio of 1/3 or even lower produces a particularly efficient selector.

If use is made for example of a hook (1), (2) with a recess which, in the cooperating position, extends along a part of the end face of a pole limb that defines an edge of the zone, there is no magnetic influencing of the hook at the location of the recess, and consequently the boundary of the zone (50) is shifted and the length (Z) of this influenceable zone will then be shorter than the distance between the top edge of the top end face and the bottom edge of the bottom end face of the associated pole limbs.

The short length (Z) of this influenceable zone (50) is very important in order to create the maximum magnetic attraction force with a specific electrical power.

When a hook is in the cooperating position (for example the left-hand hook (1) in FIG. 1), a top section of length (L) of the hook (1) projects above the guide means (9), (10); (9'), (10'). This section can be elastically deformed by the selector (11) and is therefore the section that is considered the positionable part in the context of the present patent application. The bottom edge of the influenceable zone is located at a distance referred to as the holding distance (A), above the level up to which the guide means (9), (10); (9'), (10') prevent the positionable part from being deformed. This level, also referred to as the holding point, is in this case formed by the top side of said guide means.

The holding distance (A) is at least half the length (L) of the positionable part. In other words, the positionable zone is located in that half of the positionable part that is located furthest from the holding point.

This relatively large holding distance (A) is important in order to obtain a sufficient moment (force x distance) with the two poles ($P_1$), ($P_2$), so that the magnetic forces exerted via these poles ($P_1$), ($P_2$) are utilized efficiently and result in a reliable selector with a high reaction speed.

The selector (11) also comprises, on either side above the poles ($P_1$), ($P_2$), a hook-engagement element (14), (15) on which a selected hook (1), (2) can engage in order for the hook to be held at a fixed height. Each hook (1), (2) has a holding opening (16), (17) at the top for this purpose.

For the sake of clarity, in FIGS. 1 to 7 the holding openings (16), (17), (27), (28) are illustrated diagrammatically as an interruption in the material of the hook (1), (2). Therefore, the material around the openings has not been shown here.

When the selector (11) is actuated to select a hook (1), (2) that has been placed in the cooperating position, the positionable section thereof is deformed and moved towards the selector (11). In the process, a hook-engagement element (14), (15) of the selector (11) moves into the holding opening (16), (17).

When the knife (7), (8) on which the hook (1), (2) is supported then moves downwards from the top dead centre of the movement, this hook (1), (2) remains hanging from the hook-engagement element (14), (15) of the selector (11).

The shed-forming device of FIG. 2 differs from the device shown in FIG. 1 in that the hook-engagement elements (14), (15) are positioned differently. A hook (1), (2) that has been placed in the cooperating position—the left-hand hook (1) in FIG. 2—hooks onto the hook-engagement element (14), (15) and is thus selected to remain at a fixed height when the hook is not attracted by the selector (11). The positionable part of the hook is therefore in the selection position in the undeformed state. To allow the hook to move with the knife (7), (8) on which it is supported, the hook has to be deformed by the selector (11).

In the shed-forming device shown in FIG. 3, the hooks are supported on a fixed base plank (18), and one of the hook-engagement lugs (19), (20); (21), (22) can hook onto a catching edge (23), (24) of a knife (7), (8). When the hook is not deformed, it hooks onto a knife (7), (8) and the hook is caught by the knife. The selector (11) can be actuated so as to deform the hook. Then, the hook is pulled towards the selector (11) and cannot hook onto the knife (7), (8), so that the hook remains at a fixed height on the base plank (18).

The shed-forming device shown in FIG. 4 comprises two knives (7), (8) which are driven in an up and down movement in opposite phase to one another. An elastically deformable holder (25), (26) made from spring steel is attached to the bottom of each knife (7), (8). These holders extend vertically downwards and in the vicinity of the bottom end have a holding opening (27), (28). These holders (25), (26) can be placed in a selection position or a non-selection position by the selector (11) in order for a hook (1), (2) to be held or not to be held at a fixed height. The two hooks (1), (2) are supported at a fixed height by supporting means (29), (30) and at the top are provided with a respective hook-engagement lug (31), (32) which can hook into a holding opening (27), (28) of an associated holder (25), (26).

The elastic holders (25), (26), during their up and down movement, are guided in a guide channel formed between guide means (9), (10), (9'), (10'). When a knife (7), (8) is at the bottom dead centre of its movement, the holder (25), (26) attached thereto is in a cooperating position alongside the selector (11) (this is true of the right-hand holder in FIG. 4). If the holder (25), (26) is not then attracted by the selector (11), the hook-engagement lug (31), (32) of the associated hook (1), (2) hooks into the holding opening (27), (28). This hook (1), (2) will be caught further by the knife (7), (8). If, on the other hand, the holder (25), (26) is attracted, the holder (25), (26) is pulled towards the selector (11), so that the hook (1), (2) cannot hook into the holding opening (27), (28). This hook (1), (2) will not be caught by the knife (7), (8) but rather will remain in its bottom position.

The holders (25), (26) here function as a selection element that can be moved by a selector (11) into a selection position and a non-selection position in order for a hook (1), (2) to be held or not to be held in a specific position with respect to the holder (25), (26).

When the holder (25), (26) is in the cooperating position, that section of the holder which projects beyond the guide means (9), (10), (9'), (10') forms the positionable part. In this case too, the magnetically influenceable zone is located in that half of the holder (25), (26) which is located furthest from the holding point (the level up to which the guide means prevent deformation of the holder). In other words, the holding distance (A) between the influenceable zone (50) and the holding point is at least equal to half the length of the positionable part.

In the shed-forming device shown in FIG. 5, the elastic holders (25), (26) are connected to the selector (11) located at a fixed height. The holders (25), (26) are more specifically connected to a laterally projecting edge (33), (34) of the housing of the selector (11) and in this case too extend vertically downwards and in the vicinity of the bottom end have a holding opening (27), (28). The holders (25), (26) can be placed by the selector (11) in a selection position or a non-selection position in order for a hook (1), (2) to be held or not to be held at a fixed height. A lip (1*a*), (2*a*) of the two hooks (1), (2) can be supported on a catching edge (7*a*), (8*a*) of a respective knife (7), (8) of two knives (7), (8) driven in opposite phase to one another and can thus be caught by the knife. At the top, the hooks (1), (2) are provided with a hook-engagement lug (31), (32) that can hook into a holding opening (27), (28) of an associated holder (25), (26).

The elastic holders (25), (26) are secured at a fixed height alongside the selector (11) and are therefore always in a cooperating position. When a knife (7), (8) is in the vicinity of the top dead centre, the hook (1), (2) thereby supported is at a height at which its hook-engagement lug (31), (32) can hook into the holding opening (27), (28) (this is the case for the left-hand holder in FIG. 5. When the holder (25), (26) is not then attracted by the selector (11), the hook-engagement lug (31), (32) of the associated hook (1), (2) then hooks into the holding opening (27), (28). This hook (1), (2) will be held at a fixed height by the holder (25), (26). If the holder (25), (26) is attracted, it is pulled towards the selector (11), so that the hook (1), (2) cannot hook into the holding opening (27), (28). In FIG. 5, the attracted, deformed state of the left-hand holder (25) is indicated by a dashed line. The associated hook (1) will continue to be caught by the knife (7).

The holders (25), (26) here function as a selection element which can be moved by a selector (11) into a selection position and a non-selection position in order for a hook (1), (2) to be held or not to be held in a specific position with respect to the holder.

In this embodiment (FIG. 5), the holder is fully elastically deformable from its attachment point to the selector, so that the positionable part here corresponds to the free part of the holder (25), (26) from its attachment point. The attachment point of the holder (25), (26) to the selector is in this case the holding point. The ratio between the holding distance (A) and the total length (L) of the positionable part is also in this case at least 0.5.

The shed-forming device shown in FIG. 6 differs from the device shown in FIG. 5 in that the hooks (1), (2) are positioned differently with respect to the holders (25), (26). If a holder (25), (26) is attracted by the selector (11) at the time at which the associated hook (1), (2) is in a cooperating position, the hook-engagement lug (31), (32) of the associated hook then hooks into the holding opening (27), (28). This hook (1), (2) will be held at a fixed height by the holder (25), (26). However, if the holder (25), (26) is not attracted, it remains in a position in which the hook (1), (2) cannot hook into the holding opening (27), (28). This is the case for the left-hand holder (25) and hook (1) in FIG. 6. This hook (1) will therefore continue to be caught by the knife (7).

In the shed-forming device shown in FIG. 7, the elastic holders (25), (26) are connected at the top to a fixed component of the selection device and extend vertically downwards. A lip (1*a*), (2*a*) of the two hooks (1), (2) can be supported on a catching edge of a respective knife of two knives that are driven in opposite phase to one another and can be caught by the associated knife, in a similar manner to the shed-forming devices illustrated in FIGS. 1 to 6.

The holders (25), (26) can be placed in a selection position or a non-selection position by the selector (11) in order for a hook (1), (2) to be placed or not placed in a position in which it is supported at a fixed height on the supporting elements (29), (30). When attracted by the selector (11), the bottom end part of each holder (25), (26) is intended to push against the top edge of an associated hook and to move this hook (1), (2) into a position in which its lip (1*a*), (2*a*) cannot hook onto the associated knife. When a holder (25), (26) is not attracted, it will not change the position of the associated hook, with the result that the latter remains in a position in which its lip (1*a*), (2*a*) can hook onto the associated knife.

Figure 9:
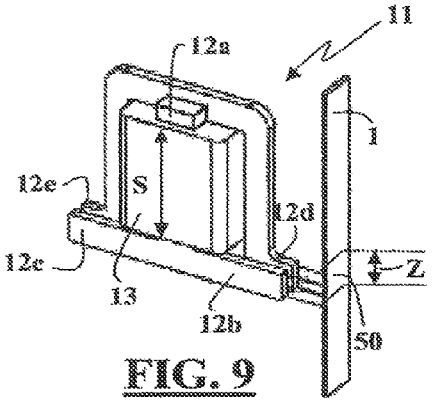

In the case of the selector (11) shown in FIG. 9, the end faces of the pole limbs are provided next to one another on each side of the selector. This arrangement of end faces extends over a distance in the longitudinal direction of the coil (13) which corresponds to the height of one of the end faces. In this way, the length (Z) of the magnetically influenceable zone (50) can be limited still further, while at the same time the holding distance (A) can be increased.

Figure 10:
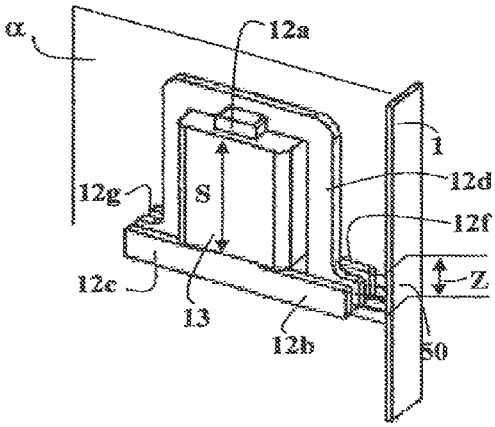

In the case of the selector (11) shown in FIG. 10, three pole limbs (12*b*), (12*d*), (12*f*) and (12*c*), (12*e*), (12*g*) are provided on each side, with their end faces located in a row next to one another at the bottom. This row extends in a direction that is transverse to the plane (a) of the pole limbs. The middle end face of the pole limb (12*d*), (12*e*) is on each side connected to the top end of the coil limb (12*a*) and has a bent path, whereas two straight pole limbs (12*b*), (12*f*) and (12*c*), (12*g*), respectively, are provided on each side in conjunction with the bottom end of the coil limb (12*a*). The end parts of these straight pole limbs (12*b*), (120, (12*c*), (12*g*) are located on either side of the end part of the middle pole limb (12*a*), so that the end faces of the three pole limbs (12*b*), (12*d*), (120 and (12*c*), (12*e*), (12*g*), respectively, are each located next to one another in virtually the same vertical plane.

In the case of the selector shown in FIG. 11, once again three pole limbs (12*b*), (12*d*), (120 and (12*c*), (12*e*), (12*g*), respectively, are provided on each side, with their end faces located in a row next to one another. This row extends in a direction that is transverse to the plane of the pole limbs. The pole limb (12*b*), (12*c*) with the middle end face is straight and connected to the bottom end of the pole limbs (12*a*), whereas two pole limbs (12*b*), (120, (12*e*) (12*g*) with a bent part are provided in conjunction with the top end of the coil limb (12*a*) on each side. The end parts of these bent pole limbs are located on either side of the end part of the middle pole limb (12*b*), (12*c*), so that the end faces of the three pole limbs are located next to one another in virtually the same vertical plane.

The provision of three or more poles in a row next to one another (see FIGS. 9 and 10) also has the advantage that the flux is better distributed through the material of the selection element, resulting in the magnetically conducting material being saturated less quickly. In this way, it will also be possible to further reduce the electric power required to realize a specific magnetic attraction force.

The selector body (12) illustrated in FIG. 12 is identical to that of FIGS. 1 to 7 and 8 and has been described above. In FIG. 12, the selector (11) interacts with a pawl (35), the top end of which is rotatably attached at an attachment point (36). The pawl (35) is positionable over its entire length. The rotatable attachment (36) also forms the holding point. The ratio between the holding distance (A) and the total length (L) of the positionable part is in this case too at least 0.5. The length (Z) of the magnetically influenceable zone is also much shorter than the coil length (S).

The selector body (12) illustrated in FIG. 14 differs from the selector body shown in FIGS. 1 to 6, 7 and 11 by virtue of the fact that the two pole limbs (12*b*), (12*d*), and (12*c*), (12*e*), respectively, run towards one another on either side in the plane of the pole limbs, so that their end parts are positioned centrally with respect to the coil length (S).

The shed-forming device shown in FIG. 15 comprises only one hook (1) which is designed as a flexible strip and can be moved up and down between guide means (9), (10) by a knife (6). There is one two-pole selector (11) which can change the position of the hook (1) in order for a holding opening (16) of this hook to hook onto or not to hook onto a fixed hook-engagement element (14) of the selector. A shed-forming device of this type may, for example, form part of a so-called "lève et baisse jacquard" with a number of knives (6) moving in phase and a heddle connected to each hook (1) so as to position warp threads.

We emphasize that a selection device according to the present invention is not necessarily provided on two sides with a number of poles for positioning a selection element. The selector (11) shown in FIG. 15 illustrates this. This selector has two poles on only one side.

The selector body (12) of the selector (11) illustrated in FIG. 15 has a coil limb (12*a*) which functions as a core and, starting from the top end of the coil (13), first of all runs upwards in the direction of the longitudinal axis (e) of the coil and then merges into a horizontal first pole limb (12*u*) running transversely to said longitudinal axis (e). At its bottom end, the coil limb (12*a*) merges into a second pole limb (12*v*) which is of the same shape as the fourth limb (12*e*) of the selector bodies described above but extends upwards to above the level of the top end of the coil (13), so that its end face ends beneath the end face of the first pole limb (12*u*).

It is also possible for a plurality of selector coils (13) together to be provided in one separately removable module. FIG. 16 shows a perspective view of the selector body (38) of a module of this type. It comprises five selector bodies (12) of the type shown in FIGS. 1 to 6, 7 and 11, which are connected to one another by means of a common bridge part (39). The bridge part consists of a material that is not magnetically conducting.

FIG. 17 shows a plate-like unit (45) with four parallel fingers (46) which are connected at one end and are intended to function as holders in cooperation with a selector and a shed-forming device. The unit (45) can be fitted as one unit into an assembly with a plurality of selectors. The fingers (46) can then be deformed by a respective selector (11) and provided with respective holding openings (47) into which, for example, the hook-engagement lugs (31), (32) as hooks (1), (2) can hook. The plate-like unit (45) is formed, for example, by stamping or laser-cutting from a single plate.

The selector (11) illustrated in FIG. 18 comprises a selector body as described above with reference to FIGS. 1 to 7, 8 and 12. This selector (11) cooperates with two arms (40), (41) which are attached on either side opposite the poles to the housing of the selector (11) by means of attachment means (42), (43) which permit rotation of the arms (40), (41) with respect to the selector. In other words, these, arms are positionable by the electromagnet over their entire length. The rotatable attachment also forms the holding point. The arms are connected to the end of spring elements (48), (49) which at the other end are connected at a fixed point, so that the spring force counteracts the magnetic attraction force of the selector (11). When the arms (40), (41) are not attracted by the selector (11), they are moved by the spring elements (48), (49) into the position shown in FIG. 18. When magnetic attraction is applied, the arms rotate towards the selector (11) counter to the spring force.

Here too, the ratio between the holding distance (A) and the total length (L) of the positionable part is at least 0.5. The length (Z) of the magnetic influenceable zone (50) measured in the longitudinal direction (d) of the arms (40), (41), is in this case too much shorter than the coil length (S).

FIG. 19 illustrates a number of different shapes of two or three end faces of associated pole limbs (12*b*), (12*c*), (12*d*), (12*e*) of a selector body.

The top row of figures shows, from left to right:

two rectangular end faces with parallel vertical longitudinal axes;

two rectangular end faces with vertical longitudinal axes located in line with one another;

one rectangular end face in which there is a round opening and a smaller circular end face located in this opening;

one rectangular end face in which there is a u-shaped recess and one smaller rectangular end face which partially extends within this recess;

The middle row of figures shows, from left to right:

two rectangular end faces with longitudinal axes perpendicular to one another, the top end face having a vertical longitudinal axis;

two rectangular end faces with vertical longitudinal axes in line with one another, wherein the edges that face one another have a V-shaped recess and a complementary V-shaped end edge;

two rectangular end faces with vertical longitudinal axes in line with one another, wherein the edges that face one another are parallel and run at an angle with respect to the longitudinal axes;

two rectangular end faces with vertical longitudinal axes in line with one another, wherein the edges that face one another have a W-shaped, complementary knurling.

The bottom row of figures, from left to right; shows:

three rectangular end faces with parallel vertical longitudinal axes;

two rectangular end faces with parallel horizontal longitudinal axes;

two rectangular end faces with longitudinal axes perpendicular to one another, wherein the top end face has a horizontal longitudinal axis.

The flexible selection elements are preferably made from hardened steel, such as C55 to C75 or such as Pt 90 to Pt 140. More generally, spring steels with a relative magnetic permeability of 700 or lower, defined at a magnetic induction B between 0.8 and 1.2 Tesla, are suitable.

The core of the selector is preferably made from materials such as soft iron (pure iron) or with a low carbon content (generally less than 0.15 percent by weight), with optionally a limited nickel or silicon content. More generally, iron grades with a relative magnetic permeability of 1000 or higher, defined at a magnetic induction B of between 0.8 and 1.2 Tesla, are suitable. Examples include DC01 to DC06, pure iron, Vacoflux, Carpenter Silicon Core Iron.

The invention claimed is:

1. A selection device for the shed-forming device of a weaving machine, comprising:

an electromagnetic selector with a coil wound around a fixed core and at least two poles connected to this core designed to form at least one magnetic north pole and at least one magnetic south pole, and a selection element with a positionable part which, when the selection element is situated in a cooperating position near the selector, comprises a magnetically influenceable zone situated next to at least two of the poles while the selection element is retained at a holding distance from this zone, in which the selector can be controlled in order to exert a magnetic force with each pole situated next to the selection element on this zone so as to place or keep the positionable part in a selection position or a non-selection position in accordance with a predetermined weaving pattern, wherein the zone extends in the longitudinal direction of the positionable part of the selection element and over a distance that is shorter than the coil length, while the holding distance is equal to at least half the length of the positionable part.

2. A selection device for the shed-forming device of a weaving machine according to claim 1, characterized in that the coil is arranged in such a manner that its longitudinal axis extends along the longitudinal direction of the positionable part of the selection element.

3. A selection device for the shed-forming device of a weaving machine according to claim 1, characterized in that the positionable part of the selection element is forced into the selection position or the non-selection position by a spring force and can be displaced to the other of these positions by the magnetic influence, counter to this spring force.

4. A selection device for the shed-forming device of a weaving machine according to claim 3, characterized in that the positionable part of the selection element is either elastically deformable and forced into the selection position or the non-selection position by its spring force, or is a rotating arm which is forced into the selection position or the non-selection position by a spring element.

5. A selection device for the shed-forming device of a weaving machine according to claim 4, characterized in that the elastically deformable positionable part of the selection element is made of spring steel.

6. A selection device for the shed-forming device of a weaving machine according to claim 1, characterized in that the selection element is a shed-forming element with a positionable part which can be placed in a selection position in which the shed-forming element is held at a fixed height and can be placed in a non-selection position in which the shed-forming element can be displaced in order to change the position of one or more warp threads in accordance with the desired weaving pattern.

7. A selection device for the shed-forming device of a weaving machine according to claim 6, characterized in that the direction of displacement of the shed-forming element corresponds to the longitudinal direction of the coil.

8. A selection device for the shed-forming device of a weaving machine according to claim 1, characterized in that the selection element is a holding element with a positionable part which can be placed in a selection position or a non-selection position in order to optionally keep a shed-forming element in a certain position with respect to the holding element so as to determine the position of one or more warp threads in accordance with the desired weaving pattern.

9. A selection device for the shed-forming device of a weaving machine according to claim 8, characterized in that the holding element is either arranged at a fixed height or is connected to a movable component of the shed-forming device.

10. A selection device for the shed-forming device of a weaving machine according to claim 8, characterized in that the holding element is either connected to a selector arranged at a fixed height or is connected to a reciprocating knife, of the shed-forming device.

11. A selection device for the shed-forming device of a weaving machine according to claim 1, characterized in that openings or recesses or local adjustments in the transverse dimensions are provided in the positionable part of the selection element.

12. A selection device for the shed-forming device of a weaving machine according to claim 1, characterized in that when the selection element is in a cooperating position near the selector, the poles are located along the same side of the positionable part.

13. A selection device for the shed-forming device of a weaving machine according to claim 1, characterized in that the distance, measured in the longitudinal direction, between the level at which the selection element is retained and the end of the coil that is closest to that level is less than the holding distance.

14. A selection device for the shed-forming device of a weaving machine according to claim 1, characterized in that the selection element comprises a first holding means that is intended to cooperate either with a second holding means of a shed-forming element in order to hold this shed-forming element in a specific position or with a second holding means which is provided at a fixed height, so that the selection element itself is held at a fixed height, and in that the zone of the selection element in any event extends between the first holding means and the level at which the selection element is retained.

15. A selection device for the shed-forming device of a weaving machine according to claim 1, characterized in that the magnetic poles are provided in such a way that their perpendicular projections onto a plane that extends in the longitudinal direction are located above or next to one another.

16. A selection device for the shed-forming device of a weaving machine according to claim 1, characterized in that the arrangement of magnetic poles, in the longitudinal direction of the coil, extends over a distance that is less than the coil length.

17. A selection device for the shed-forming device of a weaving machine according to claim 1, characterized in that the ratio between on the one hand the length of the magnetically influenceable zone of the positionable part and on the other hand the coil length is at most equal to 0.5, and is preferably no greater than 0.4.

18. A selection device for the shed-forming device of a weaving machine according to claim 1, characterized in that the ratio between the holding distance and the length of the positionable part is at least equal to 0.55.

19. Assembly of selection devices for a shed-forming device of a weaving machine, characterized in that it comprises at least two selection devices according to claim 1, and in that at least two selectors of the assembly form part of a separately removable module.

20. Assembly of selection devices for a shed-forming device of a weaving machine according to claim 19, characterized in that the selectors are incorporated in the module in at least two rows positioned at different levels.

21. Assembly of selection devices for a shed-forming device of a weaving machine according to claim 20, characterized in that the selectors of different rows are offset with respect to one another in the longitudinal direction of these rows.

22. Assembly of selection devices for a shed-forming device of a weaving machine according to claim 19, characterized in that this assembly comprises a number of selection elements which can be placed in a selection position or a non-selection position in order for a shed-forming element to be held or not to be held in a specific position in order to position one or more warp threads, and in that a plurality of these selection elements form part of the same unit.

23. Assembly of selection devices for a shed-forming device of a weaving machine according to claim 19, characterized in that the module comprises a number of selectors as well as the shed-forming elements, tackle elements and tackle cords associated with these selectors.

24. Shed-forming device for a weaving machine, characterized in that it is provided with a number of selection devices according to claim 1.

* * * * *